US008401218B2

(12) United States Patent
Son et al.

(10) Patent No.: US 8,401,218 B2
(45) Date of Patent: Mar. 19, 2013

(54) ADJUSTABLE EARPHONE AND EARPHONE SET

(75) Inventors: Sung Ho Son, Bellevue, WA (US); Gregory G. Jones, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 256 days.

(21) Appl. No.: 12/846,642

(22) Filed: Jul. 29, 2010

(65) Prior Publication Data

US 2012/0027242 A1 Feb. 2, 2012

(51) Int. Cl.
*H04R 25/04* (2006.01)
*H04R 25/00* (2006.01)

(52) U.S. Cl. ..... 381/380; 381/322; 381/324; 381/329; 381/384; 181/129

(58) Field of Classification Search ..... 381/380, 381/381, 182, 322, 324, 328, 329, 330, 23.1, 381/370, 374, 379, 384; 181/129, 130, 135
See application file for complete search history.

(56) References Cited

U.S. PATENT DOCUMENTS

| | | | | | |
|---|---|---|---|---|---|
| 4,453,050 | A | * | 6/1984 | Enokido | 381/381 |
| 4,554,993 | A | * | 11/1985 | Houng | 181/130 |
| 4,668,842 | A | * | 5/1987 | Yokoyama et al. | 381/380 |
| 5,335,285 | A | * | 8/1994 | Gluz | 381/381 |
| 5,412,736 | A | * | 5/1995 | Keliiliki | 381/381 |
| 5,533,137 | A | | 7/1996 | Holmes | |
| 5,544,253 | A | | 8/1996 | Nagayoshi et al. | |
| 5,691,515 | A | * | 11/1997 | Landis | 181/129 |
| 5,708,724 | A | * | 1/1998 | Burris et al. | 381/370 |
| 5,729,615 | A | * | 3/1998 | Yang | 381/370 |
| 5,761,298 | A | | 6/1998 | Davis et al. | |
| 5,960,094 | A | * | 9/1999 | Jensen et al. | 381/381 |
| 6,256,386 | B1 | | 7/2001 | Phillips | |
| 6,333,982 | B1 | * | 12/2001 | Sapiejewski et al. | 379/430 |
| 6,427,018 | B1 | * | 7/2002 | Keliiliki | 381/381 |
| 6,434,249 | B1 | * | 8/2002 | Wei | 381/370 |
| 6,438,248 | B1 | * | 8/2002 | Kamimura et al. | 381/374 |
| 6,532,296 | B1 | | 3/2003 | Vaudrey et al. | |
| 6,772,853 | B2 | * | 8/2004 | Yang | 181/129 |
| 6,810,987 | B1 | | 11/2004 | DeKalb | |
| 6,819,762 | B2 | | 11/2004 | Jones et al. | |
| 7,172,052 | B2 | * | 2/2007 | Lenhard-Backhaus | 181/129 |

(Continued)

FOREIGN PATENT DOCUMENTS

| | | | |
|---|---|---|---|
| DE | 4141730 | A1 | 6/1993 |
| WO | WO2010/030240 | A1 | 3/2010 |

OTHER PUBLICATIONS

"Atomic Floyd TwistJax headphones review," www.pocket-lint.com/review/4515/atomic-floyd-twistjax-headphones-review, 3 pgs. (document not dated, downloaded on Jul. 9, 2010).

(Continued)

*Primary Examiner* — Edgardo San Martin
(74) *Attorney, Agent, or Firm* — Klarquist Sparkman, LLP

(57) ABSTRACT

An earphone comprises an inner shell, a stem and a pivot connection. The inner shell has a generally circular periphery shaped to at least partially fit in a user's concha. The stem is mounted to the inner shell at a position spaced from a rotational center of the inner shell and supports a wire leading to the inner shell. The inner shell and the stem are rotatable relative to each other by the pivot connection to configure the earphone to fit the user's ear with the shell member positioned at least partially in the user's concha and the stem positioned exteriorly along an intertragic notch of the ear.

20 Claims, 5 Drawing Sheets

U.S. PATENT DOCUMENTS

| | | | | |
|---|---|---|---|---|
| 7,248,705 | B1 | 7/2007 | Mishan | |
| 7,356,156 | B2 * | 4/2008 | R egg | 381/379 |
| D598,901 | S | 8/2009 | Lee et al. | |
| 7,570,777 | B1 | 8/2009 | Taenzer et al. | |
| 7,580,541 | B2 | 8/2009 | Hlas et al. | |
| D599,781 | S | 9/2009 | Lee et al. | |
| 7,743,771 | B2 * | 6/2010 | Falco | 128/864 |
| 8,103,040 | B2 * | 1/2012 | Pelland et al. | 381/381 |
| 2003/0152244 | A1 | 8/2003 | Dobras et al. | |
| 2005/0018838 | A1 | 1/2005 | Meunier et al. | |
| 2005/0069147 | A1 | 3/2005 | Pedersen | |
| 2005/0163337 | A1 * | 7/2005 | Ruegg | 381/370 |
| 2006/0215868 | A1 | 9/2006 | Okamura et al. | |
| 2006/0285715 | A1 * | 12/2006 | Drambarean et al. | 381/380 |
| 2007/0041604 | A1 | 2/2007 | Yang | |
| 2007/0133836 | A1 * | 6/2007 | Lee | 381/370 |
| 2007/0154050 | A1 | 7/2007 | Kim | |
| 2007/0154052 | A1 | 7/2007 | Gantz | |
| 2008/0013714 | A1 * | 1/2008 | Sung et al. | 379/430 |
| 2008/0025523 | A1 | 1/2008 | Miller | |
| 2008/0037817 | A1 | 2/2008 | Ewert et al. | |
| 2008/0170738 | A1 * | 7/2008 | Hope et al. | 381/371 |
| 2008/0285786 | A1 * | 11/2008 | van der Bilt et al. | 381/381 |
| 2009/0041284 | A1 | 2/2009 | Tanaka et al. | |
| 2009/0123016 | A1 * | 5/2009 | Rise | 381/380 |
| 2009/0147982 | A1 | 6/2009 | Ashida et al. | |
| 2009/0226024 | A1 | 9/2009 | Dean | |
| 2009/0285436 | A1 | 11/2009 | Lowry | |
| 2009/0296975 | A1 | 12/2009 | Uchida et al. | |
| 2010/0061580 | A1 | 3/2010 | Tiscareno et al. | |
| 2010/0061581 | A1 * | 3/2010 | Soetejo et al. | 381/380 |
| 2010/0105447 | A1 | 4/2010 | Sibbald et al. | |
| 2010/0111348 | A1 * | 5/2010 | Tsao et al. | 381/380 |
| 2010/0158302 | A1 * | 6/2010 | Knight et al. | 381/380 |
| 2010/0220885 | A1 * | 9/2010 | Singh | 381/379 |
| 2011/0110552 | A1 * | 5/2011 | Pang et al. | 381/374 |
| 2011/0211724 | A1 * | 9/2011 | Hirata | 381/384 |
| 2012/0070028 | A1 * | 3/2012 | Margulies | 381/380 |
| 2012/0087534 | A1 * | 4/2012 | Pelland et al. | 381/380 |

OTHER PUBLICATIONS

Bell, "Atomic Floyd TwistJax Review," www.digitaltrends.com/mp3-player-reviews/atomic-floyd-twistjax-review/, 7 pgs. (document marked Mar. 2, 2010).

Brezinski, "Sennheiser CX 95 Headphones Review—Intro," www.headphoneinfo.com/content/Sennheiser-CX-95-Headphones-Review-680.htm, 2 pgs. (document marked Nov. 19, 2008).

Brezinski, "Sennheiser CX 95 Headphones Review," http://reviews.washingtonpost.com/product/Sennheiser/CX-95.htm, 1 pg. (document marked Dec. 31, 2008).

Ensha, "Earbuds That Can Feel as Good as They Sound," www.nytimes.com/2008//12/11/technology/personaltech/11ear.html?, 2 pgs. (document marked Dec. 10, 2008).

"JVC introduces the HA-F240 Air Gumy Headphones," www.krunker.com/category/audio/headphones/page/4/, 43 pgs. (document marked Jul. 31, 2008).

"Microsize Pocket Headset," downloaded from http://asia.creative.com/products/product.asp?category=437&subcategory=861&product=19166&listby=, 2 pgs. (document not dated, downloaded on Jul. 9, 2010).

Sennheiser Electronic Corporation, "Sport Series," Features and Specifications brochure, 2 pgs. (document not dated).

Wikipedia, "Headphones," http://en.wikipedia.org/wiki/Headphones, 10 pgs. (document not dated, downloaded on Jun. 21, 2010).

* cited by examiner

ADJUSTABLE EARPHONE AND EARPHONE SET

FIELD

This application relates to earphones, and in particular to a new earphone and stem that provide adjustability to fit a range of users.

BACKGROUND

Users of telephones, audio and video players and other mobile devices increasingly choose earphones for convenience, privacy and in some cases, compliance with laws allowing only hands free phones while driving. Earphones are distinguished from headphones, which are generally larger and have a head-shaped band that supports two ear pieces designed to fit over at least a portion of the ears.

Some earphones have a portion sized to be inserted at least partially into the ear canal. Although these earphones can deliver better performance in some situations, a reliable and comfortable fit is difficult to achieve for some users. In the most common earphones, however, instead of a smaller in-canal portion, a larger generally rounded portion is shaped to fit at least partially within a portion of the outer ear (external to the ear canal).

Because ear shapes vary widely, attempts have been made to allow users to adapt the fit of standard earphones for their individual requirements, which sometimes differ between the left and right ears. Some earphones are designed to accept cushions of different thicknesses to allow their fit to be adapted. Some earphones include members shaped to fit around the user's ears (like eyeglass temples) to hold the earphones in place.

There remains a need, however, for an earphone configurable to fit a wide array of users securely and comfortably that is easy to adjust and convenient to wear and remove.

SUMMARY

Described below are embodiments of an earphone that addresses disadvantages of conventional earphones and comprises an inner shell, a stem and a pivot connection. The inner shell has a generally circular periphery shaped to at least partially fit in a user's concha. The stem is mounted to the inner shell at a position spaced from a rotational center of the inner shell and supports a wire leading to the inner shell. The inner shell and the stem are rotatable relative to each other by the pivot connection to configure the earphone to fit the user's ear with the shell member positioned at least partially in the user's concha and the stem positioned exteriorly along an intertragic notch of the user's ear.

In some embodiments, the stem can be rotatable relative to the inner shell over a range of approximately 90 degrees. The stem can be rotatable relative to the inner shell through a range of pre-defined angular positions.

The pivot connection between the inner shell and the stem can be a first pivot connection, and there can be a second pivot connection located on the stem at a wire exit point and spaced away from the first pivot connection, wherein the second pivot connection allows relative rotation between the wire and support member to allow the user to adjust the position of the wire.

The earphone can comprise a wire exit point on the stem at which the wire exits the stem, and the wire exit point can be spaced from the pivot connection by a distance of about 15 mm to about 20 mm.

The pivot connection can be spaced or offset from the rotational axis of the inner shell by a distance of about 0.1 mm to about 2.0 mm.

The stem can be generally straight, and further comprise a wire exit point on the stem at which the wire exits the stem. The wire exit point can be configured to support the wire at an angle relative to the stem within the range of about 45 degrees to about 90 degrees.

The stem can be generally curved, and further comprise a wire exit point at which the wire exits the stem located at a distal end of the stem.

The stem can have a rectangular cross section with one pair of relatively longer opposing side surfaces and one pair of relatively shorter top and bottom surfaces, and wherein the rectangular cross section provides a convenient grip with which a user can fit, adjust and remove the earphone.

The stem can be made of a sound absorbing material. The stem can have a chevron-shaped distal end.

The earphone can be a first earphone, and there can be a second earphone joined to the first earphone and having a jack to form an earphone set.

In some embodiments, an earphone comprises an inner shell having a generally circular periphery shaped to at least partially fit in a user's concha, a stem mounted to the inner shell at a position spaced from a rotational center of the inner shell, the stem supporting a wire leading to the inner shell, a first pivot connection between the inner shell and the stem by which the stem and inner shell are rotatable relative to each other to configure the earphone to fit the user's ear with the shell member positioned at least partially in the user's concha and the stem positioned exteriorly along an intertragic notch of the ear and a second pivot connection on the stem at a location spaced apart from the first pivot connection, the second pivot connection allowing the wire entering the stem to be rotated relative to the stem to allow the user to reposition the wire relative to the stem over an angular range.

DETAILED DESCRIPTION

Figure 1:
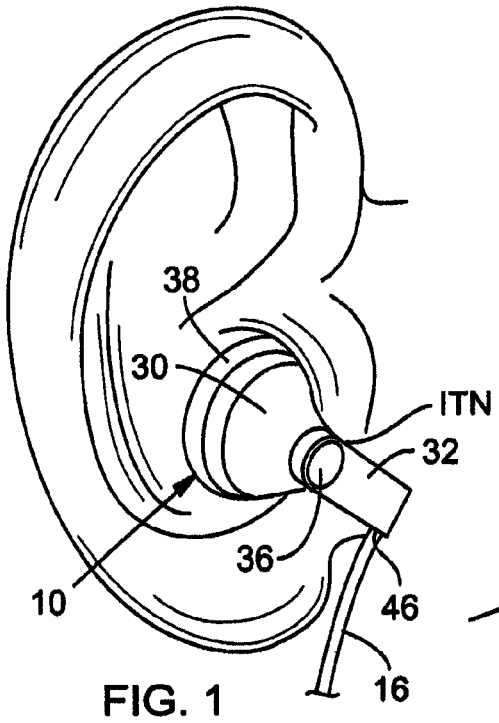
FIG. 1 is a perspective view of an earphone according to a new design as worn in a user's right ear.
Figure 2:
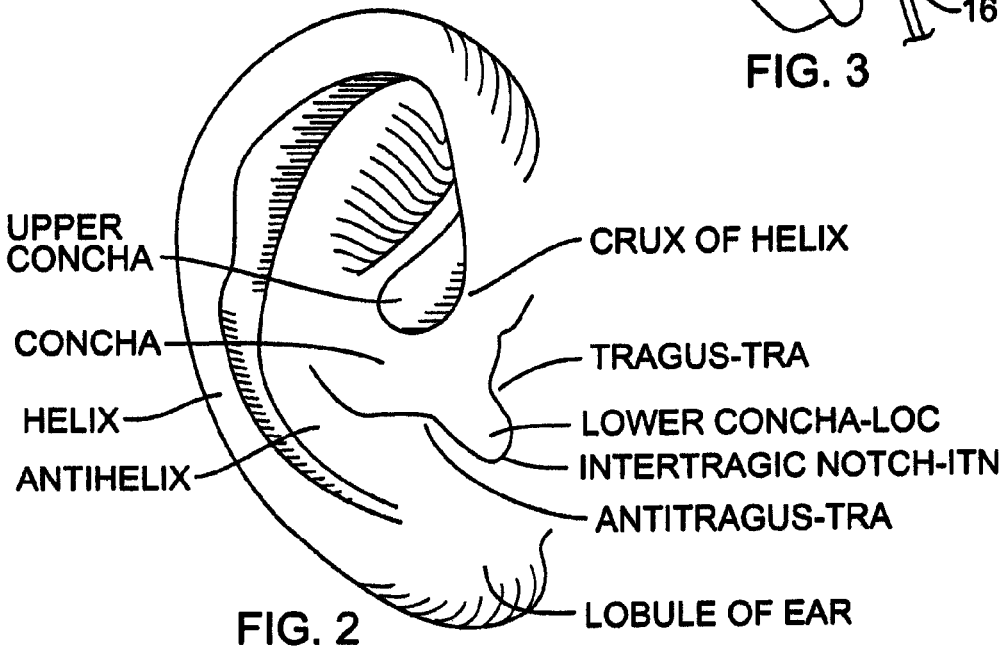
FIG. 2 is a perspective view of a human ear showing the intertragic notch defined between the tragus and the antitragus.

Referring to FIGS. 1 and 2, an earphone 10 for a right ear is illustrated in its position as worn in the intertragic notch ITN of a user's right ear. The earphone 10 has an inner portion, comprising an inner shell 30, and an outer portion, comprising a stem 32. When the earphone 10 is worn in the intertragic notch ITN as shown, the inner shell 30 occupies the lower concha LCO of the outer ear (FIG. 2). The inner shell 30 is configured to have a smooth periphery and is sized to fit within a typical LCO. The inner shell 30 has a neck 34, and the stem 32 is joined to the inner shell 30 at the neck 34 by a pivot connection 36. The pivot connection allows the user to rotate the inner shell 30 relative to the stem 32 to provide for a better earphone fit, as is described below in greater detail.

Referring to FIG. 2, which shows the outer ear anatomy for a typical right ear in more detail, the intertragic notch ITN is a generally curved narrowing separating the lobular tragus from the lobular antitragus. The lower concha LCO is a relatively wider area located to the inside of the intertragic notch, i.e., in a direction into the page, and to the inside of the tragus and intertragus as well. From right to left in the figure, the lower concha LCO is the lower region of the concha, and there is also an upper concha region. The antihelix, helix and crux of helix generally lie outside of the concha regions.

The inner shell 30 has an interior recess (not shown) for receiving electronic components, including at least a speaker, and is configured with one or more openings for emitting sound from the speaker into the user's ear. In preferred embodiments, the inner shell 30 has an outer periphery that is approximately circular, although an eccentric or other rounded periphery is also possible. The inner shell 30 and the stem 32 are pivotably connected at the neck 34 by the pivot connection 36. The neck and pivot connection 36 are located slightly off axis, i.e., slightly spaced from the center of the inner shell such that the distance between a pivot axis at the pivot connection 36 and a point on the periphery varies with the angle along which it is measured.

Figure 9:
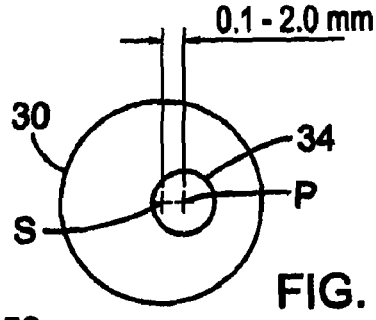
FIG. 9 is a simplified schematic view of the inner shell and the offset neck and pivot axis.

FIG. 9 is a schematic view of the inner shell 30 and the neck 34 to show the offset between the pivot axis P (or axis of rotation) on the neck, and the geometric or rotational center S of the inner shell 30. As shown in FIG. 9, the pivot axis P is offset from the geometric center S (or rotational center) by a distance typically ranging from 0.1 mm to about 2.0 mm.

Referring again to FIG. 1, the inner shell 30 may comprise an optional ear contact element, such as the ring-shaped ear contact 38 as shown in the drawings, to assist in fitting the earphone in a suitable position within the ear and retaining it in position during various activities. The ear contact element 38 is preferably formed of rubber or another similar resilient material that is comfortable and has a warmer feel than metal or plastic when it first makes contact with the user's ear.

Figure 8:
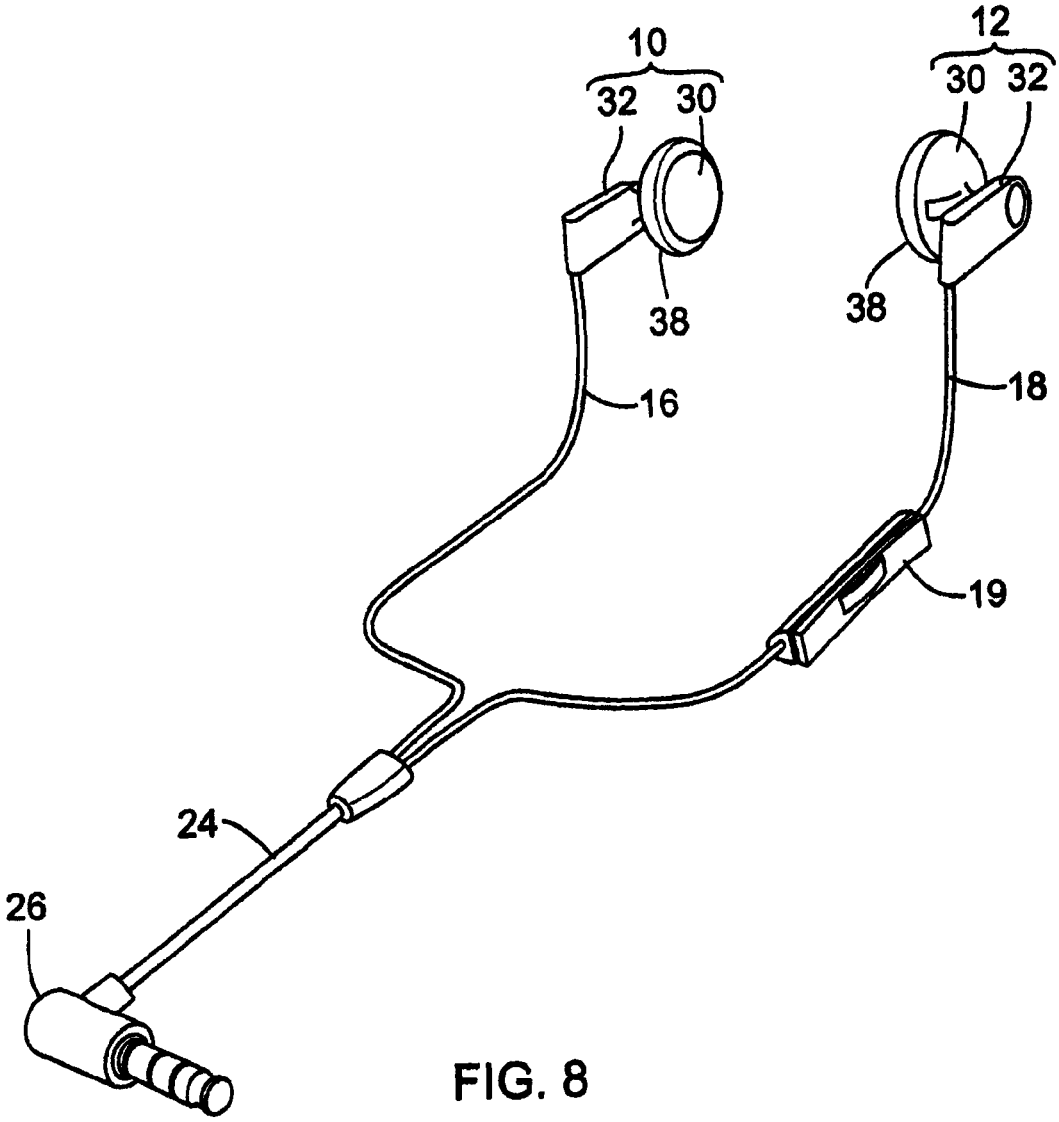
FIG. 8 is a perspective view of an earphone set having left and right earphones according to the new design.

Referring again to FIG. 1, the stem 32 has an elongated configuration and is sized to at least partially cover the wire 16 that extends from the inner shell, through the neck and over the length of the stem 32 before eventually terminating in a jack (see FIG. 8). In the illustrated embodiments, the stem 32 has one or more pairs of generally opposing surfaces, such as, e.g., inner and outer large surfaces 42*a*, 42*b* and upper and lower small surfaces 44*a*, 44*b* that provide convenient places for the user to grasp to insert, adjust or remove the earphone 10. For example, in FIG. 3, a user has grasped the earphone on the upper surface 44*a* and the lower surface 44*b* (not visible in the figure), or by another suitable combination of the surfaces, to remove the earphone 10 from her ear.

Figure 3:
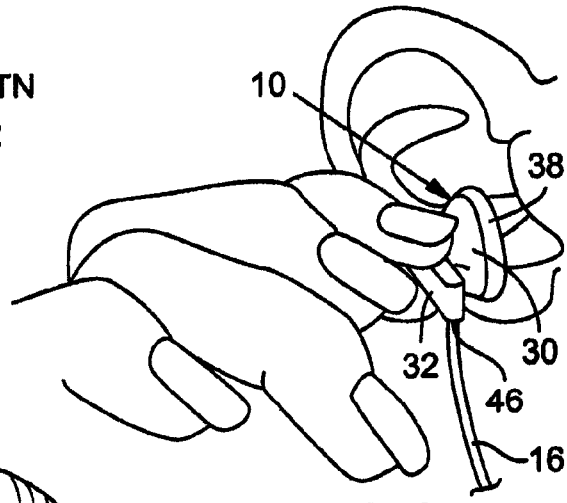
FIG. 3 is a perspective view showing the user removing the earphone from her right ear by grasping a stem.

A wire exit point 46 on the stem 32 is defined at the location where the wire 16 exits or emerges from, or is no longer covered by, the stem 32. In some embodiments, such as is shown in FIGS. 1 and 3, the wire exit point 46 is located approximately at a distal end 40 of the stem 32. A wire spacing distance W is defined between the pivot connection 36 (axis P) and the wire exit point 46. As shown in the drawings, by configuring the stem 32 to provide a sufficient wire spacing distance W, the wires 16, 18 are spaced apart from the ears and the face of the user, which many users find more comfortable and less distracting. In the illustrated embodiments, the wire spacing distance is approximately 15-20 mm. Also, in the illustrated embodiments, the wire spacing distance W is at least on the same order as and possibly greater than a diameter or major dimension of the inner shell.

FIGS. 4A and 4B, FIGS. 4C and 4D, and FIGS. 4F and 4F show the inner shell 30 pivoted to three different angles relative to the stem 32, resulting in three different shell fit dimensions as indicated by the dimensions a, b and c as shown.

Figure 4B:
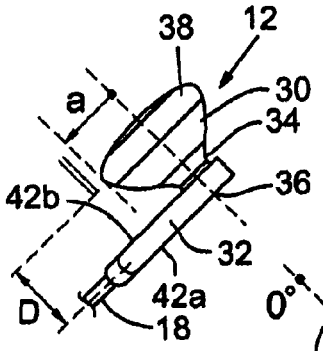
FIGS. 4A and 4B are side and top views, respectively, of the earphone pivoted to a first position.
Figure 4A:
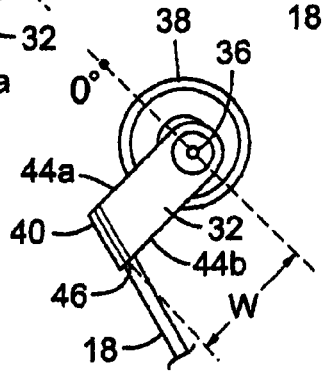

FIG. 4A is side view of the ear phone 12 for the left ear set for a predetermined fit distance and generally oriented for wearing, and FIG. 4B is a corresponding plan view. FIG. 4B shows that the inner shell 30 has been rotated relative to the stem until the shell fit dimension measured along the axis of the stem is at a minimum. This configuration defines a shell fit dimension "a" and is designated as a 0 degree angular offset.

Figure 4D:
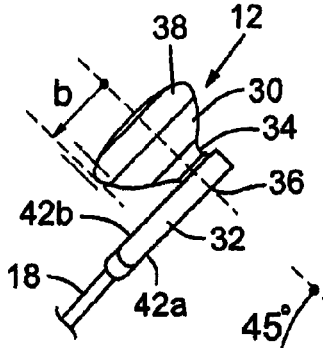
FIGS. 4C and 4D are side and top views, respectively, of the earphone pivoted to a second position.
Figure 4C:
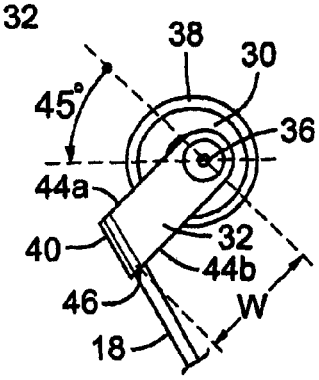

In FIGS. 4C and 4D, the inner shell 30 has been rotated 45 degrees relative to its position in FIGS. 4A and 4B. In this position, the configuration defines a shell fit dimension "b" greater than "a," as can be seen by comparing the dimension lines of FIGS. 4D and 4B. This configuration is designated as a 45 degree offset.

Figure 4F:
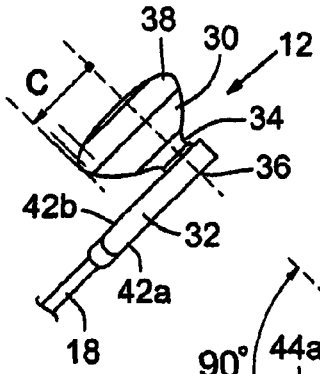
FIGS. 4E and 4F are side and top views, respectively, of the earphone pivoted to a third position.
Figure 4E:
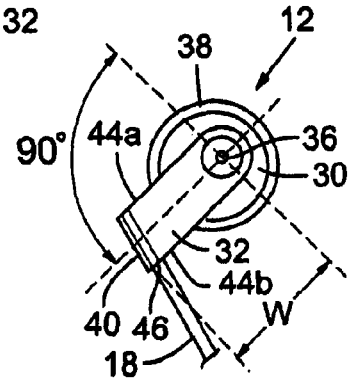

In FIGS. 4E and 4F, the inner shell 30 has been rotated a further 45 degrees from the position shown in FIGS. 4C and 4D. In this position, the configuration defines a shell fit dimension "c" greater than "b" and greater than "a" as can be seen by comparing the dimension lines of FIGS. 4F, 4D and 4B. This configuration is designated as a 90 degree offset.

In the illustrated embodiments, the relative rotation between the inner shell 30 and the stem 32 can range from approximately 0-90 degrees. In the case of an inner shell 30 with other than a circular periphery, a different range may apply. Although three positions, i.e., 0, 45, and 90 degrees have been specifically described, continuous adjustability or adjustability among a finite number of positions (e.g., detents) can be provided. The range in shell fit dimension allows the user to adapt the earphones to fit her ears so that they are comfortable to wear, provide a good listening experience and remain in place during activities (e.g., exercise). It may be the case, e.g., that a particular angular offset for one earphone results in a shell fit dimension that more appropriately fits the user's lower concha for that ear.

Referring again to FIG. 4B, a dimension D is defined from about the largest periphery of the inner shell 30 laterally to the inner side of the stem 32. Although the earphone can be configured to have any desired dimension D, in the illustrated embodiments D ranges between about 9 mm and about 11 mm.

FIGS. 5A-5G are drawings adapted from photographs of actual ears to illustrate the variability in the size and orientation of the intertragic notch and other features. The direction of each arrow is generally aligned with the longitudinal direction of the intertragic notch, and the length of each arrow is representative of a typical stem.

One way in which the earphone 10 provides for a better fit than conventional ear phones is by allowing the user to adjust the position of the inner shell, i.e., by allowing the inner shell to be rotated while the position of the stem remains constant. This has been described above in connection with fitting the earphone 10 to the user's lower concha and intertragic notch. In addition, with reference to FIGS. 11A and 11B, the fit can also be adjusted to position the inner shell 30 or a specific portion thereof at a desired position relative to the ear canal EC. The ear canal or auditory canal is the passage through which sound travels to the inner ear.

Figure 11A:
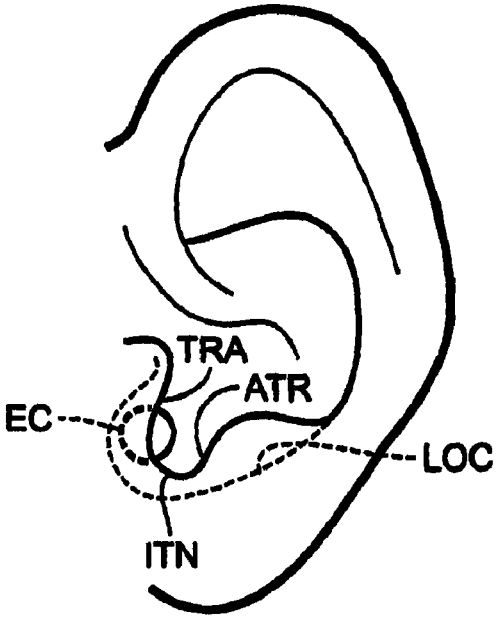
FIGS. 11A and 11B are additional side views of different ears showing how the relative position of the ear canal and the shape of the concha, as two examples, can differ.
Figure 11B:
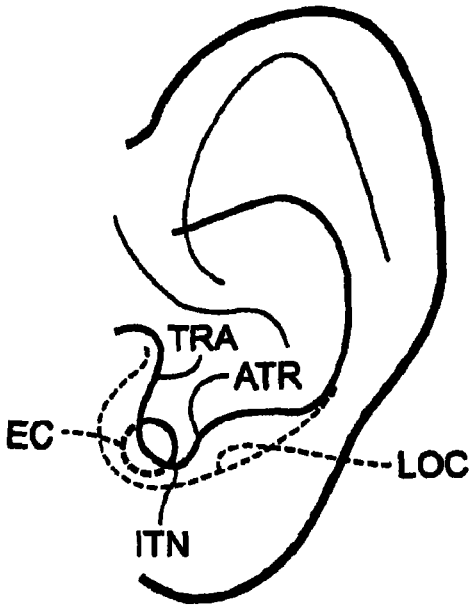

In FIG. 11A, which is a side view of a first ear, the ear canal EC is shown offset to the left from the intertragic notch ITN. Part of the ear canal is obscured by the tragus TRA (note that in the particular view of FIG. 2, the tragus TRA obscures all of the ear canal EC from view). In FIG. 11B, which is a side view of a second ear, the ear canal EC is generally aligned with the intertragic notch ITN. As in FIG. 11A, the tragus obscures part of the ear canal EC from view. In addition, the general lower concha area in which the earphone would be received, also referred to herein as the ear pocket, is shaped differently in FIG. 11B than in FIG. 11A.

Although not specifically illustrated in the drawings, it is of course possible to vary the angle of the stem relative to the inner shell, e.g., after the earphone is in place, from the approximately constant inclination shown in the drawings, which may be desired by some users seeking to have the wire 18 in a different position.

Figure 6:
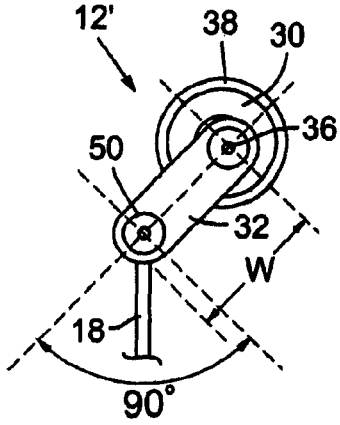
FIG. 6 is a side view of another embodiment in which a second pivot connection between the stem and the wire is provided.
Figure 5A:
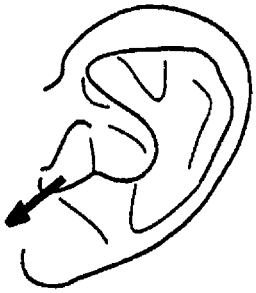
FIGS. 5A-5G are further views of various ears illustrating the different sizes, orientations and configurations of the intertragic notch and surrounding areas.
Figure 5B:
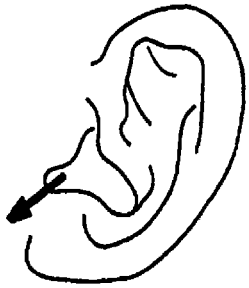
Figure 5C:
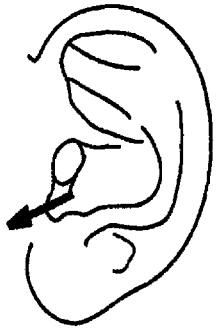
Figure 5D:
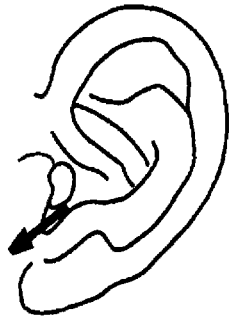
Figure 5E:
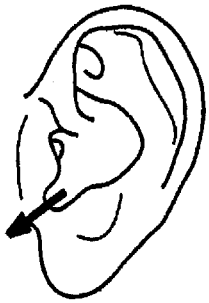
Figure 5F:
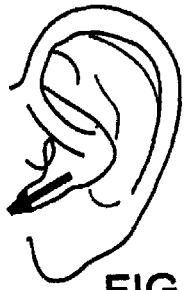
Figure 5G:
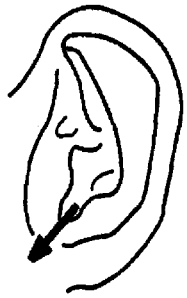

FIG. 6 is a side view of an earphone 12' according to another embodiment. In the earphone 12', a second pivot connection 50 is provided at the wire exit point. The second pivot connection 50 provides for additional adjustment, including in the position of the wire 18 relative to the user's face.

Figure 7A:
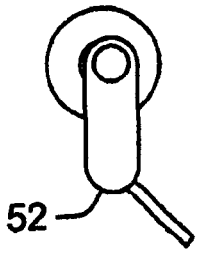
FIGS. 7A, 7B and 7C are side views of various alternative designs of the stem.
Figure 7B:
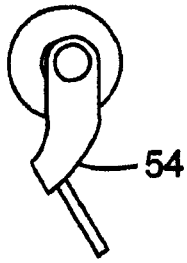
Figure 7C:
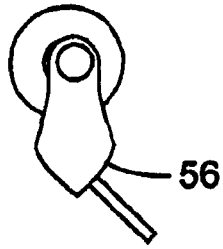

FIGS. 7A, 7B and 7C are side views of the earphone 12 or 12' included to show optional configurations of the stem 32. In FIGS. 1, 3, 4A-4G and 6, the stem has a generally straight axis. In FIGS. 1, 3 and 4A-4G, the wire exits from the stem 32 at an angle of less than 90 degrees, i.e., at about 74 degrees. In FIG. 7A, the distal end 52 is rounded. In FIG. 7B, the body of the stem 54 is curved rather than straight. In FIG. 7C, the stem has a chevron-shaped distal end 56. Optionally, the stem can be colored or fitted with indicia to make the earphone more aesthetically pleasing to the user.

Figure 10B:
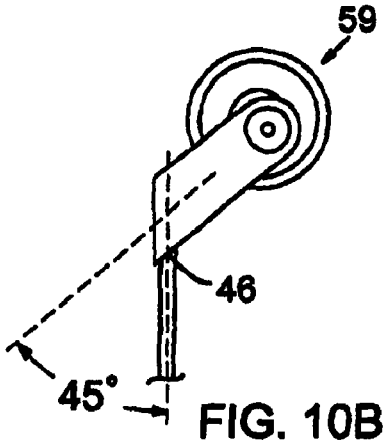
FIGS. 10A and 10B are side views of earphones configured to provide different wire exit angles.
Figure 10A:
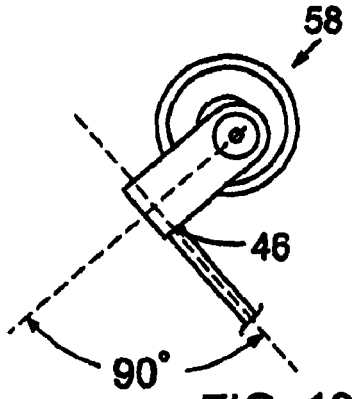

FIG. 10A is a side view of another earphone 58 in which the wire exits from the stem at an angle of about 90 degrees relative to an axis of the stem. FIG. 10B is a side view of another earphone 59 in which the wire 18 exits from the stem at an angle of about 45 degrees relative to an axis of the stem. Of course, these and wire exit angles are possible by adjusting the earphone 12' with the second pivot connection 50 of FIG. 6. In the ear phones 58, 59, the wire exit point W is defined at or near the distal end of the stem.

FIG. 8 is a perspective view of an earphone set 60 showing the earphone 10 and the wire 16 for the right ear and the earphone 12 and the wire 18 for the left ear, which are joined together at a junction 22 into a combined wire segment 24 that terminates in a conventional jack 26. In the illustrated embodiment, the wire 18 for the left ear is fitted with an in-line control 19, e.g., to control the volume and/or other functions of the phone, mobile device or player to which the set is connected.

The inner shell 32 can be made of any suitable material, such as a plastic. The stem can also be made of any suitable material that is at least slightly stiffer or less resilient than the wire it supports, such as rubber or another elastomeric material. In some embodiments, the stem is made of a material that has sound absorbing qualities to reduce the extent that outside noise detracts from the listening experience.

An earphone set having the earphone as described above can be used in place of any conventional earphone set, e.g., to connect to mobile phones, audio and video players, game devices, radios, and all other devices having an audio jack. In addition, the principles of the earphone design may be applied in other situations where a component must be fit to a user's ear or ears.

In view of the many possible embodiments to which the disclosed principles may be applied, it should be recognized that the illustrated embodiments are only preferred examples and should not be taken as limiting in scope. Rather, the scope of protection is defined by the following claims. We therefore claim all that comes within the scope and spirit of these claims.

We claim:

1. An earphone, comprising:

an inner shell having a generally circular periphery shaped to at least partially fit in a user's concha; and a stem mounted to the inner shell at a mounting position spaced from a center of the inner shell, the stem supporting a wire leading to the inner shell;

a pivot connection between the inner shell and the stem defined along a pivot axis extending through the mounting position, and the inner shell, and by which the stem and inner shell are rotatable relative to each other to configure the earphone to fit the user's ear with the inner shell positioned at least partially in the user's concha and the stem positioned exteriorly along an intertragic notch of the ear.

2. The earphone of claim 1, wherein the stem is rotatable relative to the inner shell over a range of approximately 90 degrees.

3. The earphone of claim 1, wherein the stem is rotatable relative to the inner shell through a range of pre-defined angular positions.

4. The earphone of claim 1, wherein the pivot connection between the inner shell and the stem is a first pivot connection and the pivot axis is a first pivot axis, further comprising a second pivot connection located on the stem at a wire exit point and along a second pivot axis spaced away from the first pivot connection, wherein the second pivot connection allows relative rotation between the wire and support member to allow the user to adjust the position of the wire.

5. The earphone of claim 1, further comprising a wire exit point on the stem at which the wire exits the stem, and wherein the wire exit point is spaced from the pivot connection by a distance of about 15 mm to about 20 mm.

6. The earphone of claim 1, wherein the pivot connection is offset from the rotational axis of the inner shell by a distance of about 0.1 mm to about 2.0 mm.

7. The earphone of claim 1, wherein the stem is generally straight, further comprising a wire exit point on the stem at which the wire exits the stem that is configured to support the wire at an angle relative to the stem of about 75 degrees.

8. The earphone of claim 1, wherein the stem is generally curved, further comprising a wire exit point at which the wire exits the stem located at a distal end of the stem.

9. The earphone of claim 1, wherein the stem has a rectangular cross section with one pair of relatively longer opposing side surfaces and one pair of relatively shorter top and bottom surfaces, and wherein the rectangular cross section provides a convenient grip with which a user can fit, adjust and remove the earphone.

10. The earphone of claim 1, wherein the stem is made of a sound absorbing material.

11. The earphone of claim 1, wherein the earphone is a first earphone, further comprising a second earphone joined to the first earphone and having a jack to form a earphone set, and wherein the earphone set is configured for use with a mobile phone.

12. The earphone of claim 1, wherein the stem has a chevron-shaped distal end.

13. An earphone, comprising:

an inner shell having a generally circular periphery shaped to at least partially fit in a user's concha;

a neck formed on the inner shell;

a wire extending from the inner shell and through the neck; and a stem rotatably connected to the inner shell at the neck about an axis extending through the inner shell and neck, the stem supporting the wire having defined thereon a wire exit point at which the wire exits the stem, wherein the axis is off center such that distances between the axis and points on the generally circular periphery are not entirely uniform;

wherein the wire exit point is spaced from the neck and the wire exits the stem at an angle of between about 60 degrees and about 90 degrees.

14. The earphone of claim 13, wherein the stem is rotatable relative to the inner shell over a range of approximately 90 degrees.

15. The earphone of claim 13, wherein the stem is rotatable relative to the inner shell through a range of pre-defined angular positions.

16. The earphone of claim 13, wherein the wire exit point is spaced from the neck by a wire spacing distance of about 15 mm to about 20 mm.

17. The earphone of claim 13, wherein the stem is rotatable relative to the inner shell to allow a position of the inner shell when within the user's concha to be adjusted relative to an ear canal adjoining the user's concha.

18. The earphone of claim 13, wherein the earphone is a first earphone, further comprising a second earphone joined to the first earphone and having a jack to form a earphone set.

19. An earphone, comprising:

an inner shell having a generally circular periphery shaped to at least partially fit in a user's concha; and a stem mounted to the inner shell at a mounting position spaced from a center of the inner shell, the stem supporting a wire leading to the inner shell;

a first pivot connection between the inner shell and the stem defined along a first pivot axis extending through the mounting position, and the inner shell and by which the stem and inner shell are rotatable relative to each other to configure the earphone to fit the user's ear with the shell member positioned at least partially in the user's concha and the stem positioned exteriorly along an intertragic notch of the ear; and a second pivot connection on the stem at a location spaced apart from the first pivot connection, the second pivot connection allowing the wire entering the stem to be rotated relative to the stem to allow the user to reposition the wire relative to the stem over an angular range.

20. The earphone of claim 19, wherein the angular range of the second pivot is about 0 to about 90 degrees.

* * * * *